United States Patent [19]

Baba

[11] 4,144,956

[45] Mar. 20, 1979

[54] SINGLE LEVER CONTROL UNIT FOR ENGINES

[75] Inventor: Masanao Baba, Takarazuka, Japan

[73] Assignee: Nippon Cable Systems Inc., Hyogo, Japan

[21] Appl. No.: 828,857

[22] Filed: Aug. 29, 1977

[30] Foreign Application Priority Data

Aug. 8, 1977 [JP] Japan ..... 52-106311[U]

[51] Int. Cl.[2] ..... G05G 9/08

[52] U.S. Cl. ..... 192/0.096; 74/480 B; 74/876; 74/877

[58] Field of Search ..... 74/876, 877, 480 B; 192/0.096, 0.098

[56] References Cited

U.S. PATENT DOCUMENTS

| | | | |
|---|---|---|---|
| 3,127,785 | 4/1964 | Morse et al. | 192/0.096 X |
| 3,309,938 | 3/1967 | Pervier | 192/0.096 |
| 3,741,044 | 6/1973 | Baba | 192/0.096 X |
| 3,741,045 | 6/1973 | Kobayashi | 192/0.098 X |

*Primary Examiner*—Allan D. Herrmann

*Attorney, Agent, or Firm*—Armstrong, Nikaido, Marmelstein & Kubovcik

[57] ABSTRACT

A control unit comprising a casing, a drive shaft rotatably supported by the casing, a lever having a boss secured to the drive shaft, a shift rod extending through the boss and slidably inserted in a bore of the drive shaft, the shift rod being biased by a spring in a returning direction, a locking ring turnably supported on the outer periphery of the drive shaft, a drive gear rotatably supported by the drive shaft and having a toothed portion on part thereof and a circular outer peripheral surface continuous with the toothed portion, a driven gear rotatable by the drive gear, a drive plate having a drive pin implanted therein, a throttle cam having a specified cam groove receiving the drive pin therein and mounted on a pin on the driven gear movably in a direction at right angles to the drive shaft, a clutch arm having a clutch cable pivoted thereto, and a throttle arm having a throttle cable pivoted thereto. The control unit operates the clutch and throttle mainly of a marine engine by the single lever, ensuring efficient warm-up operation and control of the engine.

8 Claims, 6 Drawing Figures

SINGLE LEVER CONTROL UNIT FOR ENGINES

BACKGROUND OF THE INVENTION

This invention relates to improvements in a single lever control unit for operating the clutch and throttle mainly of marine engines.

With single lever control units, the clutch is engaged for positive (forward) or reverse (rearward) operation by turning the lever from its neutral position through a specified angle, and the throttle is thereafter advanced by further turning the lever to rotate the engine at a high speed. For warming up the engine, therefore, such control units require means which holds the clutch out of engagement despite the turn of the lever through the sepcified angle and by which the throttle alone can be adjustably operated.

Although several engine warming-up means for control units of this type are known, they have at least one of the drawbacks of being difficult and inconvenient to operate, involving the possibility that the clutch will be engaged in its positive or reverse position when the boat is subjected to the impact of waves or the like during warm-up, having poor durability and including an exposed portion prone to desposition of the salt of seawater or dust and therefore to a malfunction. These drawbacks would lead to a serious accident, either directly or indirectly.

Furthermore with a certain type of engines, it is desired that the throttle cable be rendered operative by a push and also by a pull, whereas the conventional control units of the type described are so adapted that the throttle cable can be operated only by a single action, namely by a push or pull. Although the throttle is operated usually over different ranges for forward and reverse operations, the devices heretofore available are unable to efficiently control the engine in accordance with the different operation ranges.

SUMMARY OF THE INVENTION

An object of this invention is to provide an improved single lever engine control unit.

Another object of this invention is to provide a single lever engine control unit by which the throttle can be held out of operation until the engine clutch is completely engaged, and the clutch can be held in its fully engaged position while the throttle is in operation.

Another object of this invention is to provide a single lever engine control unit incorporating engine warming-up means which is easy to operate and which ensures warm-up operation with safety.

Another object of this invention is to provide a single lever engine control unit including a throttle cam which has an improved cam groove for controlling the engine with high efficiency.

Still another object of this invention is to provide a single lever engine control unit by which the throttle cable can be operated by a push and also by a pull.

Other objects of this invention will become apparent from the following description with reference to the accompanying drawings.

DESCRIPTION OF THE PREFERRED EMBODIMENTS

Figure 1:
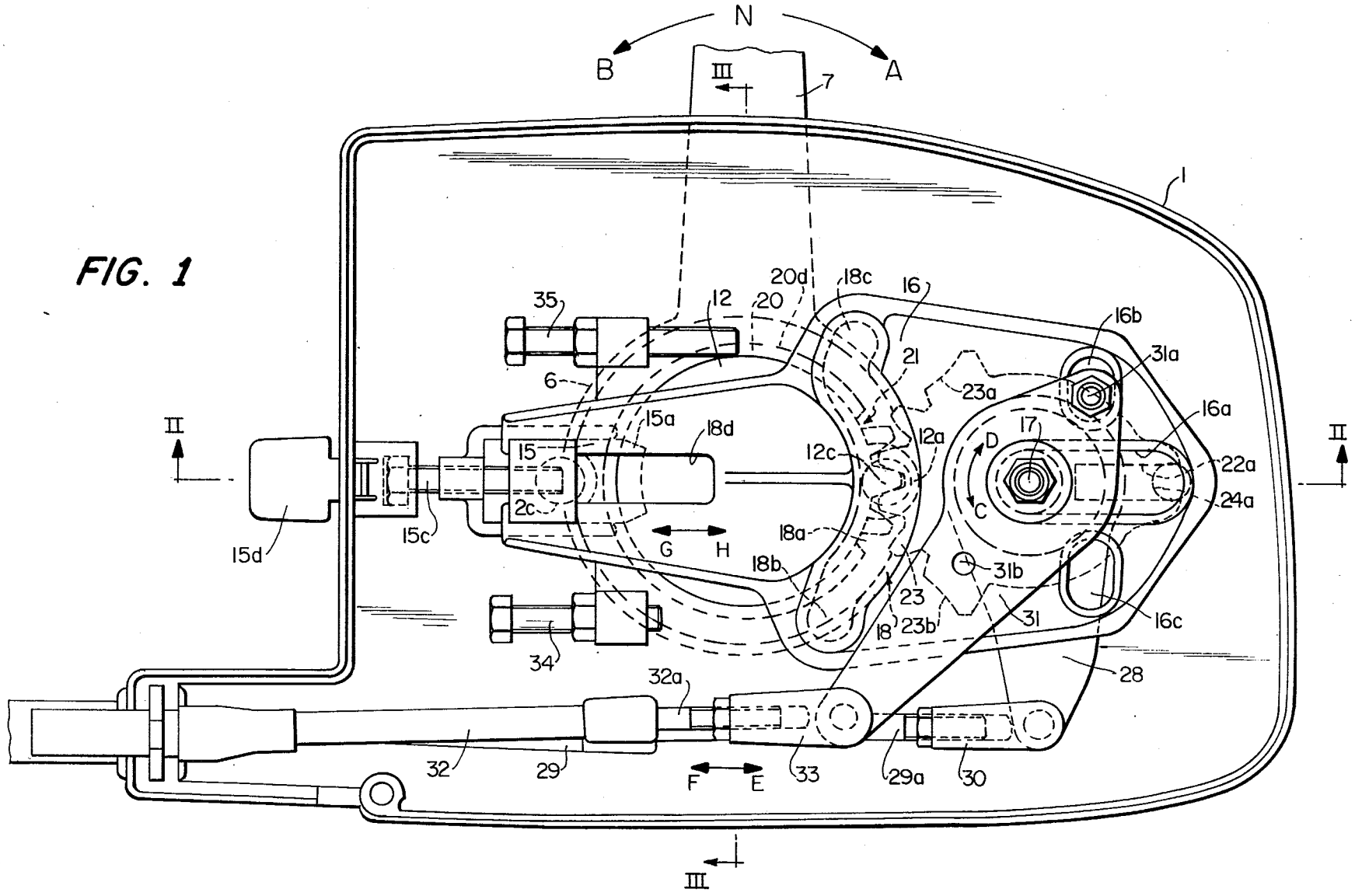
FIG. 1 is a front view showing an embodiment of the unit of this invention with the cover of its casing removed.

With reference to FIGS. 1 to 4, an outer casing 1 houses an inner casing 2 comprising a base plate 2*a* and a cover 2*b* which are fastened to the outer casing 1 by bolts 2*c* and 2*d*. A drive shaft 3 extending through an opening 1*a* formed in the outer casing 1 is supported by apertured portions 2*e* and 2*f* of the base plate 2*a* and cover 2*b* of the inner casing 2. A boss 6 secured by bolts 6*a* to one end of the drive shaft 3 is fixedly provided with a lever 7. The lever 7 is provided on its inner side with locking means 71 for supporting the lever 7 in its neutral position. The locking means 71 comprises an operating plate 72 coextensive with the inside surface of the lever 7 and a pin 73 attached to the outer casing 1. The operating plate 72 is L-shaped in section at its one end to provide a bent portion 72*a* which has a knob 72*c* downwardly biased by a spring 72*b*. The operating plate 72 includes at the other end thereof an enlarged portion 72*e* formed with a cutout 72*d* and a slanting lower edge as illustrated. The operating plate is mounted on the lever main body by a bolt 72*f* passed through a slot 72*e'* in the enlarged portion 72*e* and is movable longitudinally thereof. The pin 73 is engageable in the cutput 72*d*.

The drive shaft 3 is formed in its center with an axial bore 4 having a shift rod 5 slidably inserted therein. The other end of the drive shaft 3 is formed, over a specified axial length, with cutout grooves 8 and 8 extending radially from the bore 4.

The shift rod 5 fixedly carries an engaging pin 9 and a retaining pin 10 intersecting the axis of the rod 5 at right angles. Disposed between the engaging pin and the retaining pin is a locking ring 11 turnable on the outer peripheral surface of the drive shaft 3. The locking ring has bent locking pawls 11*a* and 11*a* and engagement means in the form of a recessed portion 11*b* in its outer periphery.

A drive plate 12 is secured by screws 13 to the other end of the drive shaft 3. A spring 14 accommodated in the bore 4 is disposed between the inside surface of the drive plate 12 and the retaining pin 10 in a slightly compressed state. The drive plate 12 is in the form of a disk having a projection 12*a* and formed, on one side thereof facing the drive shaft 3, with a slanting peripheral edge 12*b*. A drive pin 12*c* is mounted on the projection 12*a* of the drive plate 12 and has a cover 12*d*.

A drive plate restraining piece 15 in the form of a rubber or plastic plate has a slanting surface 15*a* for contact with the slanting edge 12*b* of the drive plate 12 and is formed with guide grooves 15*b* for guiding the throttle cam to be described later. The restraining piece 15 is supported by a bolt 15*c* on the cover 2*b* of the inner casing 2. The bolt 15*c* is turnable by a knob 15*d* on the outer casing 1 and is thereby movable in the directions of arrows a and b in FIG. 2.

A throttle cam 16 is movably supported by a pin 17 extending through an elongated aperture 16*a* in the cam 16 and implanted in the driven gear to be described later. The pin 17 has a bush 17a for rendering the throttle cam movable with ease. The cam has on the opposite sides of the aperture 16a apertures 16b and 16c for connection to one end of the throttle arm to be described later. The throttle cam 16 further has a cam groove 18 movably receiving the drive pin 12c therein. The cam groove 18 comprises a circular arc first cam 18a centered about the axis of the drive shaft 3, and a second cam 18b and a third cam 18c extending from the opposite ends of the first cam respectively away from the center of the first cam 18a at different angles. The second cam extends at a smaller angle than the third cam relative to the first cam. In the other end of the throttle cam 16 on the opposite side to the aperture 16a, the cam 16 has an elongated groove 18d extending longitudinally thereof. The opposed side edges defining the groove 18d fit in the guide grooves 15b of the drive plate restraining piece 15.

A drive gear 20 is rotatably supported by the drive shaft 3 and has a toothed portion 21 on part of its outer periphery. The drive gear 20 has a cavity 20a accommodating the locking ring 11. The interior surface defining the cavity 20a is formed with an engaging portion in the form of an axial projection 20b, the engaging portion being in engagement with the engagement means of the locking ring 11, i.e., with the recess portion 11b thereof.

A driven gear 22 is rotatably supported by apertured portions 2g and 2h formed in the base plate 2a and the cover 2b of the inner casing 2. The gear 22 is formed on part of its outer periphery with a toothed portion 23 meshable with the toothed portion of the drive gear 20 and two locking portions 23a and 23b continuous with the opposite ends of the toothed portion 23. On the other side of the gear 23 opposite to the toothed portion 23, the gear has a radial bore 22a receiving therein a spring 24 and a projectable restraining pin 24a biased by the spring 24. The restraining pin 24a is engageable in and disengageable from a neutral position notch, forward position notch and reverse position notch (not shown) formed in the peripheral wall of the inner casing 2. A clutch arm 28 is secured to the boss portion 27 of the driven gear 22. The end (which is usually in the form of a rod) of the inner wire 29a of a clutch cable 29 connected to the unillustrated clutch means of the engine is pivoted to one end of the arm 28 by a member 30.

A throttle arm 31 is turnably supported by the pin 17 as if holding and supporting the throttle cam 16 and is connected to the cam 16 by a bolt 31a inserted in the bore 16b of the cam. Pivoted to one end of the throttle arm 31 by a member 33 is the end (usually in the form of a rod) of the inner wire 32a of a throttle cable 32 connected to the unillustrated throttle means of the engine. The arm 31 is formed with a hole 31b which will be used for connecting the arm 31 to the cam 16 by an unillustrated bolt passed through the hole 31b and aperture 16c.

Indicated at 34 and 35 are stoppers engageable with the projection 12a of the drive plate 12 to limit the forward and reverse operation ranges of the lever 7 respectively. The forward operation range covers a range in which the lever is turnable through 105° from its neutral position, while the lever is turnable through 75° from its neutral position for reverse operation. The clutch is operated throughout the 45° range from the neutral position in each of the operation ranges, the remainder of the operation range being a throttle operating range.

A waterproof cover 36 covering the head 5a of the shift rod 5 is fitted over the boss 6.

The operation and advantages of the control unit of this invention will be described below. When the lever 7 is in its neutral position, the operating plate 72 is held depressed by the spring 72b, with the pin 73 engaging in the cutout 72d of the enlarged portion 72e to lock the plate in the depressed position. The knob 72c, when pulled up, raises the operating plate 72, disengaging the cutout portion 72d from the pin 73 to render the lever 7 turnable. The lever 7 is then turned from its neutral position N in a direction A, rotating the drive shaft 3 in the same direction A. The engaging pin 9 engaging in the cutout grooves 8 therefore turns also in the direction A, rotating the drive gear 20 in the same direction A since the pin 9 is in engagement with grooved portions 20c formed in the bottom surface defining the cavity 20a of the drive gear 20. By virtue of the meshing engagement of the toothed portion 21 with the toothed portion 23, the gear 20 rotates the driven gear 22 in a direction C. Consequently, the inner wire 29a of the clutch cable 29 pivoted to the end of the clutch arm 28 is pulled in a direction E to engage the clutch for example in its positive (forward) position. The restraining pin 24a is brought out of its neutral position into its forward position. At this time, the locking portion 23a is in sliding contact with the outer peripheral surface 20d of the drive gear 20, whereby the drive gear 22 is locked against rotation. As the lever 7 is further turned in the direction A, the drive pin 12c moves out of the first cam 18a into the second cam 18b in pushing contact with the inward peripheral edge of the second cam 18b. This moves the throttle cam 16 in a direction G along the guide grooves 15b of the drive plate restraining piece 15, whereby the throttle arm 31 connected at its one end to the cam 16 at the aperture 16b is turned in the direction C, pulling the inner wire 32a of the throttle cable 32 in the direction E and thereby advancing the throttle to propel the boat forward. As the drive plate 12 is further turned by the lever 7, the projection 12a thereon comes into contact with the stopper 34, which stops the rotation of the plate 12, permitting the boat to advance at a maximum speed.

When the lever 7 is turned in a direction B, the drive gear 20 similarly rotates in the direction B, rotating the driven gear 22 in a direction D. The clutch arm 28 thereby turned pushes the inner wire 29a of the clutch cable 29 in a direction F and engages the clutch in its reverse (rearward) position. The restraining pin 24a is brought out of its neutral position to its reverse position. The rotation of the drive shaft 3 in the direction B moves the drive pin 12c from the first cam 18a into the third cam 18c, causing the pin 12c to push the inward peripheral edge of the cam 18c and thereby moving the cam 16 in the direction G, i.e., in the same direction as when the lever 7 is turned in the direction A. This turns the throttle arm 31 in the same direction C, pulling the inner wire 32a of the throttle cable 32 in the direction E and advancing the throttle to propel the boat rearward. When the lever is further turned, the projection 12a of the drive plate 12 comes into contact with the stopper 35, permitting the boat to travel at a maximum reverse speed.

When it is desired to maintain an accelerated forward or reverse speed, the knob 15d is turned to shift the restraining piece 15 in the direction b, bringing the slanting surface 15a of the piece 15 into contact with the slanting edge 12b of the drive plate 12, with the result that the drive plate 12 is prevented from turning by being firmly held between the throttle cam 16 and the restraining piece 15.

Figure 5:
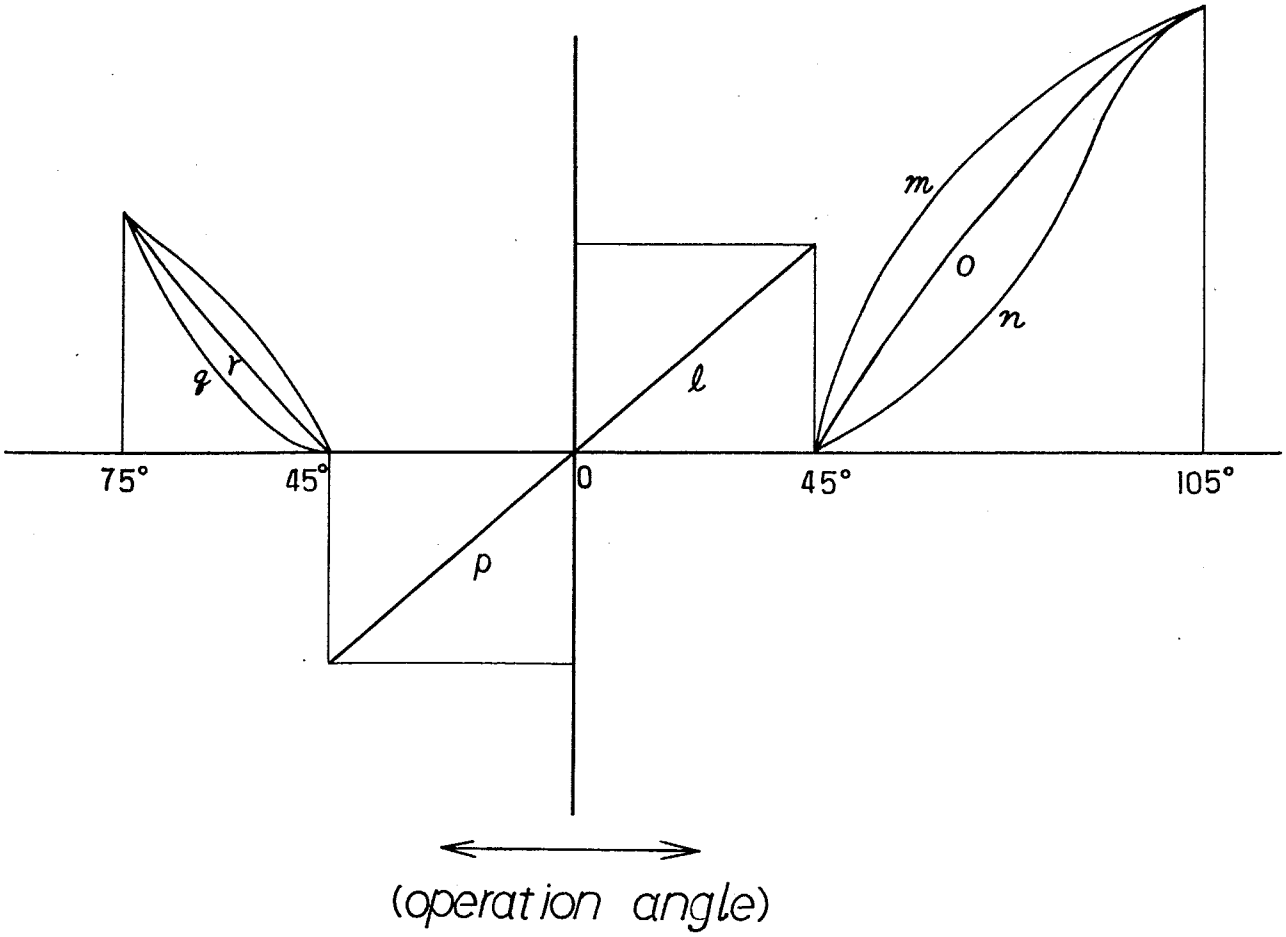
FIG. 5 is a diagram illustrating the relationship of the turn of a lever with clutch and engine operations as well as with control of the rotation of an engine.

With reference to FIG. 5, the relationship between the operation ranges of the lever and clutch and throttle operations will be described as well as control of the rotation of the engine. When the lever 7 is turned in the direction A, the clutch is operated as represented by a straight line l before the clutch is engaged in its forward position while the lever is angularly displaced over a range of up to 45°. As the lever is further turned with the clutch engaged for forward operation, the throttle will be operated. If the operation of the throttle in this case varies linearly like the clutch, the butterfly valve of the gasoline engine would be opened at a constant rate, so that the number of the resulting revolutions of the engine would be represented by a curve m shown. This indicates that the number of revolutions of the engine increases sharply at low speeds, thus presenting difficulty in controlling the rotation of the engine. To eliminate such difficulty, the throttle cam 16 is so designed that the second cam **18*b* for forward operation extends from the circular arc first cam 18*a* at a relatively small angle in a direction away from the center of the cam 18*a*** as already described. A curve n represents the throttle operation achieved by this structure. It is seen that the operation involves reduced variations at low speeds and greater variations as the speed increases. A curve o represents the control of revolution number of the engine thus actually achieved. The engine is smoothly controllable, therefore.

When the lever is turned in the reverse direction B, the clutch is operated as represented by a straight line p before the clutch is engaged for reverse operation while the lever is turned over an angular range of up to 45°. As the lever is further turned in the direction B with the clutch engaged in its reverse position, the throttle will be advanced. Since the lever is adapted to be turned downward toward the operator for reverse operation, the lever is not easy to manipulate, and it is difficult to provide a large reverse operation range unlike forward operation. Thus, the lever is operative for a reduced reverse range. The third cam **18*c* for reverse operation is so formed that it extends from the circular arc first cam 18*a* at a larger angle than the forward cam 18*b* in a direction away from the center of the cam 18*a*** to give accelerated speeds within the small range. A curve q represents the throttle operation thus achieved, and a curve r the control of revolution number of the engine.

Figure 2:
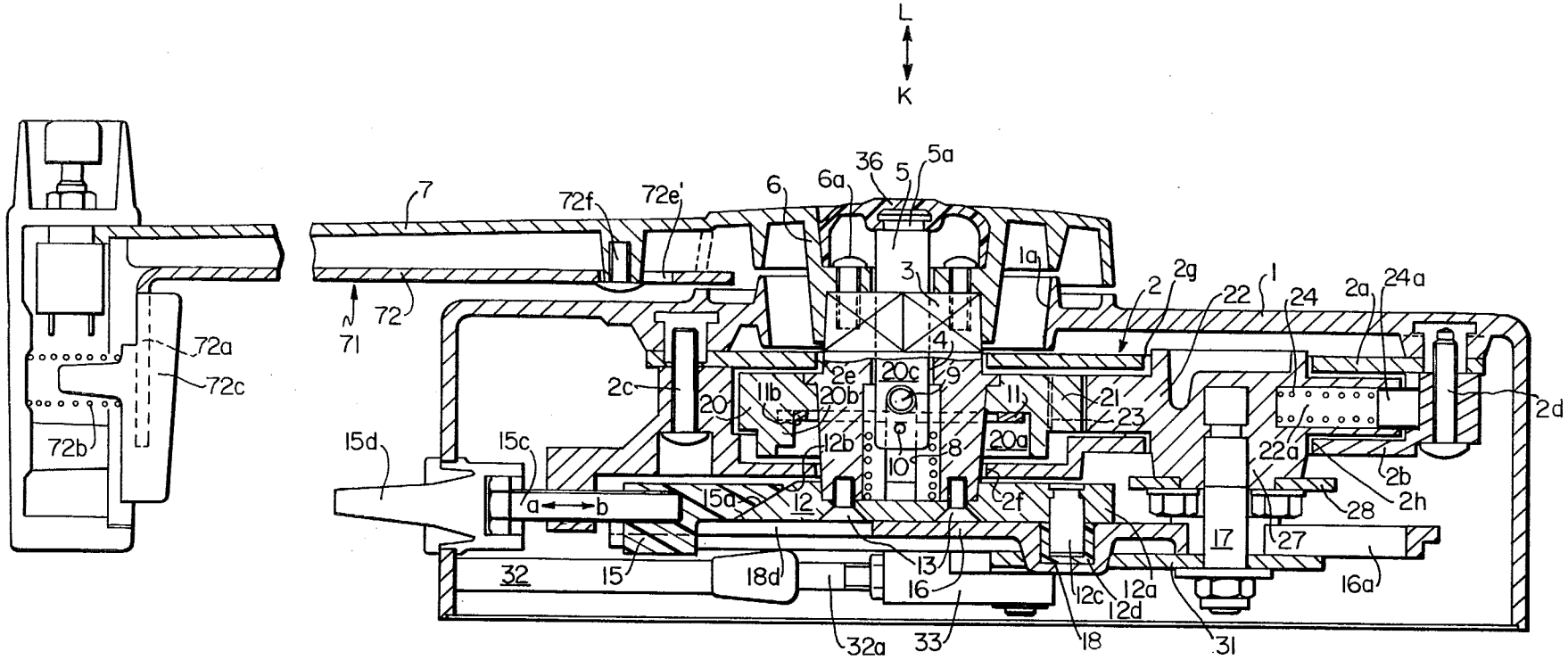
FIG. 2 is a view in section taken along the line II—II in FIG. 1.
Figure 3:
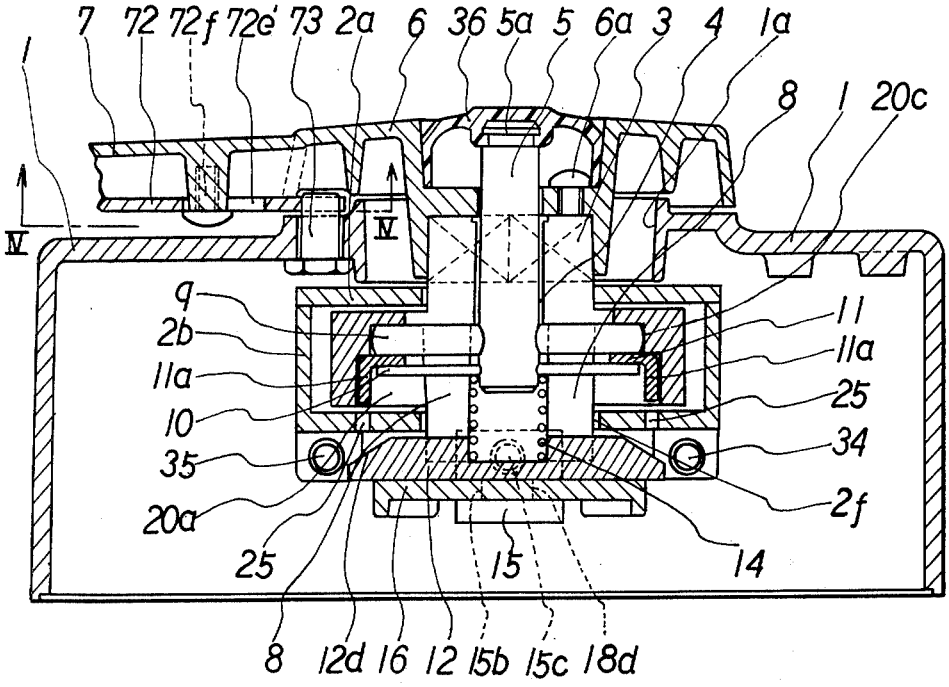
FIG. 3 is a view in section taken along the line III—III in FIG. 1.
Figure 4:
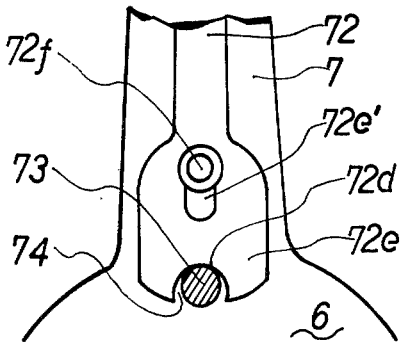
FIG. 4 is a front view showing lever locking means.

The control unit operates in the following manner when warming up the engine. With reference to FIG. 2 when the head **5*a* of the shift rod 5 is pushed in a direction K, the shift rod is depressed, compressing the spring 14 and moving the engaging pin 9 through the cutout grooves 8 in the direction K out of engagement with the grooved portions 20*c* of the drive gear 20. With the locking ring 11 moved also in the direction K, the pawls 11*a* thereof engage in the locking holes 25 (see FIG. 3) formed in the cover 2*b* of the inner casing 2. By virtue of the engagement of the projection 20*b* on the drive gear 20 in the recessed portion 11*b* of the locking ring 11, the drive gear 20 is locked. When the lever 7 is turned in the direction A with the parts thus positioned, the rotation of the drive shaft 3 rotates the shift rod 5 along with the engaging pin 9. Since the drive plate 12 turns also in the direction A, the movement of the drive pin 12*c* in the cam groove 18 forces the throttle cam 16 toward the direction G, turning the throttle arm 31 in the direction C to pull the inner wire 32*a* of the throttle cable 32 in the direction E. The wire advances the throttle, permitting the engine to rotate at an increased speed for warming up as desired. Since the engaging pin 9 turns in sliding contact with the bottom surface 20*f* of the cavity 20*a* in the drive gear 20, the shift rod 5 need not be held depressed after the operator has started to turn the lever 7**.

During the warm-up operation described, the driven gear 22, which is in meshing engagement with the drive gear 20, is prevented from rotation to retain the clutch in its neutral position free of engagement even when the boat is subjected to the impact of waves or the like. The engine can be warmed up with safety, accordingly.

As the lever 7 is returned to the neutral position N after the warm-up operation, the engaging pin 9 comes into facing relation to the grooved portions **20*c* of the drive gear 20, whereupon the pin 9 is brought into engagement with the grooved portions 20*c* by the action of the spring 14. The shift rod 5 automatically returns in a direction L, and the pawls 11*a* of the locking ring 11 are disengaged from the locking holes 25. The engine is now controllable by the lever 7** in the usual manner.

Because of the foregoing construction and function, the control unit of this invention greatly facilitates the warm-up operation and can be changed-over to the usual operation with extreme ease, since the shift rod 5 is automatically returnable in the direction L to the position of FIG. 2 by returning the lever 7 to its neutral position N.

According to this invention, the lever 7 can be held in position by the locking means 71 when the clutch is in its neutral position. Accordingly, even when the lever is subjected to a force inadvertently, the clutch will be held out of engagement, allowing the boat to remain in position. The locking means 71 includes a clearance 74 between the pin 73 and the edge of the cutout **72*d* of the operating plate 72 on the lever so as to absorb the backlash to be produced between the working parts. This serves to prevent the locking of the lever before the clutch has been fully disengaged, rendering the lever lockable when it is completely brought to its neutral position. The slanting lower edge of the operating plate 72 acts to hold the plate in its raised position against the action of the spring 72*b* when the lever is turned sidewise in either direction. The knob 72*c* of the locking means 71** needs to be gripped only when the lever is to be disengaged from its neutral position. The locking means is therefore advantageous in that it eliminates the necessity of gripping the knob during the turn of the disengaged lever.

According to this invention, the drive shaft 3, waterproof means provided in the clearance between the shaft 3 and the shift rod 5 and covered with the cover 36, engaging pin 9, locking ring 11, spring 14, engageable locking means including the pawls **11*a* and holes 25** and like means for the warm-up operation are almost all housed in the outer casing or inner casing, so that the parts are protected from ingress of saline water very effectively. Thus, the present control unit is operable free of any malfunction or like troubles and with high durability. Because of the features described, the warm-up means as well as operating means of this invention can be provided with a very compact construction at a low cost.

Efficient control can be assured by the throttle cam 16 including a cam for forward operation and another cam for reverse operation which are so designed as already described.

Figure 6:
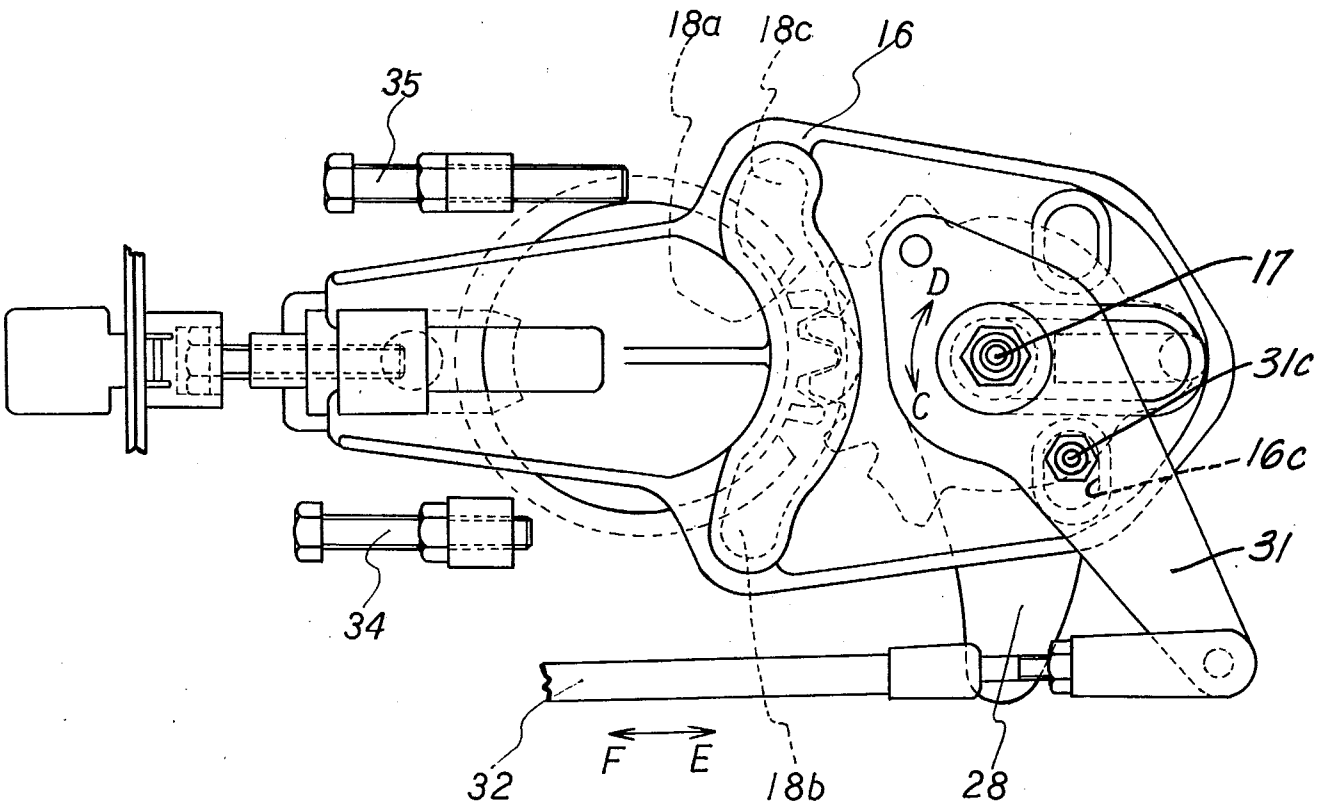
FIG. 6 is a fragmentary front view showing the unit of this invention as it is used in a different mode.

The technical concept of this invention is not limited to the embodiment described above. As shown in FIG. 6, the throttle arm 31 may be connected to the throttle cam 16 by a bolt 31c (the bolt 31a is usable as such) which is passed through the hole 31b in the arm 31 and the aperture 16c in the cam. With this arrangement, the lever, when turned, turns the throttle arm in the direction D, pushing the inner wire of the throttle cable 32 in the direction F to advance the throttle.

The spring 14 may be provided on the upper side of the shift rod 5 near the head 5a. The engaging pin 9 may be provided only on one side of the shift rod 5 for engagement with a cutout groove 8 and a grooved portion 20 which are formed on one side only. The projection 20b (engaging portion) may alternatively be in the form of a groove for engagement with a projection substituting the recessed portion 11b (engagement means).

This invention is in no way limited to these embodiments but can be modified variously without departing from the spirit of the invention.

What is claimed is:

1. A single lever engine control unit comprising:

(a) a cover member of a casing having locking holes, (b) a drive shaft rotatably supported by the casing and formed with an axial bore and a cutout groove extending radially from the bore, (c) a lever having a boss secured to the drive shaft, (d) a shift rod extending through the boss and slidably inserted in the bore of the drive shaft, the shift rod being biased by a spring in a returning direction and provided with an engaging pin and a retaining pin movable through the cutout groove, (e) a locking ring turnably supported on the outer periphery of the drive shaft and disposed between the engaging pin and the retaining pin, the locking ring having locking pawls cooperative with the locking holes and engagement means at its outer periphery, (f) a drive gear rotatably supported by the drive shaft and having a toothed portion on part thereof and a circular outer peripheral surface continuous with the toothed portion, the drive gear being formed with a cavity accommodating the locking ring, a grooved portion in the bottom surface of the cavity for receiving the engaging pin therein and an engaging portion provided axially of the cavity and engageable with the engagement means of the locking ring, (g) a driven gear rotatably by the drive gear and provided with a toothed portion positioned on part thereof and meshable with the toothed portion of the drive gear, locking portions disposed on the opposite sides of the toothed portion for contact with the outer peripheral surface of the drive gear, and a pin implanted therein, (h) a drive plate secured to the drive shaft and having a drive pin implanted therein, (i) a throttle cam having a cam groove receiving the drive pin therein and mounted on the pin on the driven gear movably in direction at right angles to the drive shaft, the cam groove comprising a circular arc first cam centered about the axis of the drive shaft, and a second cam and a third cam extending from the opposite ends of the first cam respectively in directions away from the center of the first cam and slanting at different angles to the first cam, (j) a clutch arm turnable by the driven gear and having a clutch cable pivoted to its one end, and (k) a throttle arm rotatably supported by the pin on the driven gear and having a portion connected to the throttle cam and one end pivotally connected to a throttle cable.

2. A single lever engine control unit as defined in claim 1 wherein the throttle cam has an elongated aperture receiving the pin on the driven gear therein, apertures formed on the opposite sides of the elongated aperture respectively for mounting the throttle arm, and an elongated groove formed in the other end thereof and having a drive plate restraining piece fitting therein.

3. A single lever engine control unit as defined in claim 2 wherein the throttle arm is formed with two holes corresponding to the mounting apertures of the throttle cam and is thereby rendered mountable on the throttle cam in different modes to provide different means for operating a throttle.

4. A single lever engine control unit as defined in claim 2 wherein the drive plate has a slanting peripheral edge and the drive plate restraining piece has a slanting surface for contact with the peripheral edge, the restraining piece being movable toward the drive plate.

5. A single lever engine control unit as defined in claim 1 wherein the drive plate is provided on a peripheral edge portion thereof with a projection having the drive pin implanted therein, the projection being engageable with stoppers for stopping the turn of the lever.

6. A single lever engine control unit as defined in claim 1 wherein the lever is provided with locking means on its inner side, the locking means comprising an operating plate coextensive with the inside surface of the lever and a pin attached to the casing, the operating plate having at its one end a knob downwardly biased by a spring and at the other end thereof an enlarged portion formed with a cutout, the pin of the locking means being engageable in the cutout.

7. A single lever engine control unit as defined in claim 6 wherein the locking means includes a clearance between the pin and the cutout portion to absorb the backlash to be produced between the working parts.

8. A single lever engine control unit as defined in claim 6 wherein the enlarged portion of the operating plate formed with the cutout has a slanting lower edge to hold the operating plate in its raised position against the downwardly biasing force of the spring during the turn of the lever.

* * * * *